United States Patent [19]

McDonough

[11] Patent Number: 4,550,925

[45] Date of Patent: Nov. 5, 1985

[54] BOAT DOLLY

[76] Inventor: Stephen L. McDonough, 12242 Dayton Ave. N., Seattle, Wash. 98133

[21] Appl. No.: 547,862

[22] Filed: Nov. 2, 1983

[51] Int. Cl.[4] ..... B62B 1/14

[52] U.S. Cl. ..... 280/47.13 B; 114/344

[58] Field of Search ..... 280/47.13 R, 47.13 B, 280/414.1, 414.2; 114/61, 344; D12/101

[56] References Cited

U.S. PATENT DOCUMENTS

| | | | |
|---|---|---|---|
| 2,551,040 | 5/1951 | Newell | 280/47.13 B |
| 2,624,591 | 1/1953 | Choplin | 280/47.13 B |
| 2,792,232 | 5/1957 | Elmore | 280/47.13 B |
| 2,978,257 | 4/1961 | Barker | 280/414.2 X |
| 3,689,950 | 9/1972 | Jalowiecki et al. | 114/56 X |
| 3,754,772 | 8/1973 | Carn | 280/47.13 B |
| 3,831,211 | 8/1974 | Bustamante | 280/47.13 B |
| 3,977,690 | 8/1976 | Carn | 280/47.13 B |
| 4,059,282 | 11/1977 | Prickett | 280/47.13 B |
| 4,127,281 | 11/1978 | Ferguson | 280/47.13 B |
| 4,214,774 | 7/1980 | Kluge | 280/47.13 B |
| 4,327,933 | 5/1982 | Tuggle | 280/414.2 |
| 4,392,665 | 7/1983 | Miller et al. | 280/47.13 B X |
| 4,434,992 | 3/1984 | Beach-Thomas | 114/344 X |

*Primary Examiner*—Joseph F. Peters, Jr.
*Assistant Examiner*—Michael Mar
*Attorney, Agent, or Firm*—Christensen, O'Connor, Johnson & Kindness

[57] ABSTRACT

A boat dolly for use with a multihull boat having right and left hull portions on opposite sides of a center skeg includes a first arm that closely fits between the right hull portion and the center skeg and a second arm that closely fits between the left hull portion and the center skeg. A backplate is affixed to first ends of the first and second arms and is adapted to abut the transom of the boat when the boat is positioned on the dolly. At least one support yoke assembly depends from the first and second arms and is adapted to closely fit the exterior of the center skeg. The support yoke transfers the load of the boat from the arms to a pair of wheels rotatably mounted on the support yoke assembly. The wheels provide mobility to the dolly. Preferably, the arms, backplate and support yoke assembly are of unitary construction and made of a nonporous plastic material. Also, preferably the first and second arms are hollow. At least one transom strap and a forward harness are provided to further secure the boat to the dolly.

14 Claims, 4 Drawing Figures

Fig. 3.
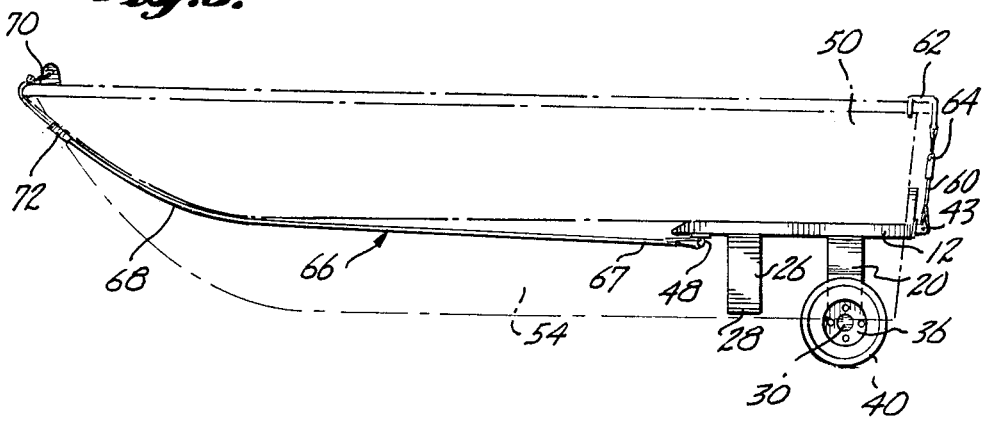
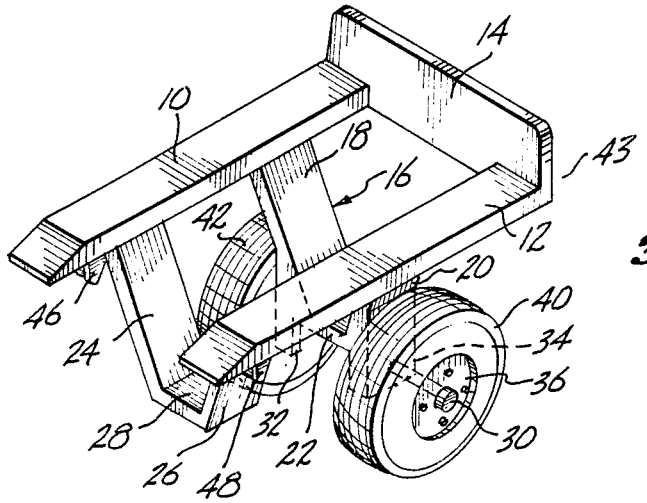
Fig. 1.
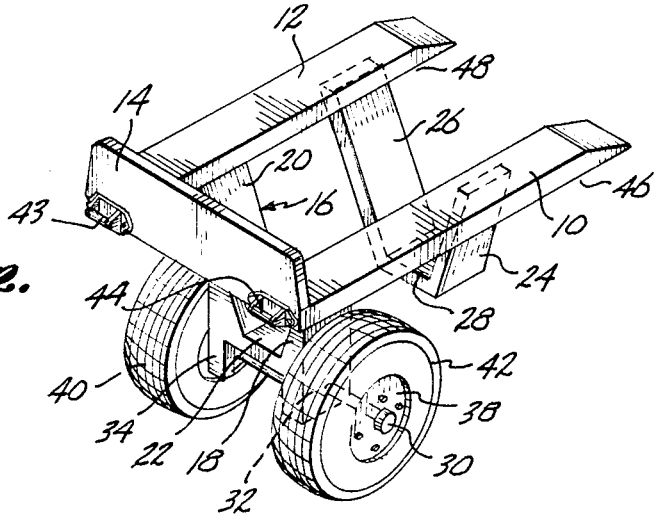
Fig. 2.

BOAT DOLLY

BACKGROUND OF THE INVENTION

This invention relates to transport means for moving large objects, particularly boats, and in particular relates to a boat dolly for use in moving a small boat over a short distance.

A problem faced by fishermen, hunters, and other persons using small boats, typically rowboats or boats with small outboard engines on them, is in moving the boat to the water, particularly when the boater is alone. While most small boats can be carried to a location near the water on the top of a car or in the bed of a pickup truck, it is still necessary to get the boat from the car or truck parked near the water, to the water.

Many different apparatus are currently available for trailering boats to the water, however, they are, in most cases, designed for larger motorboats and are too large to be justified for moving a small boat, such as an eight-foot or ten-foot rowboat or pram. Also, it is desirable to have a means of transport for the boat that is both easily attachable to the boat and equally easily removable therefrom. In recent years, boats of the multihull design, such as those manufactured by Livingston, Incorporated of Auburn, Washington, have become very popular due to their stability in relation to their size. Typically, such a boat will have a right and left main hull portion and a center skeg lying intermediate the right and left hull portions. It is therefore an object of this invention to provide a boat dolly for use with a small multihull boat.

It is a further object of this invention to provide such a boat dolly that is easily attached to the boat and just as easily removed from the boat by one person to make it easier for an individual to maneuver a small boat into the water.

SUMMARY OF THE INVENTION

In accordance with the above-stated objects, a boat dolly for use with a multihull boat includes a first elongate arm constructed and arranged to fit between the right hull portion of the multihull boat and the center skeg of the boat and a second elongate arm constructed and arranged to fit between the left hull portion and the center skeg of the multihull boat. A support yoke depends downwardly from the first and second elongate arms and is constructed and arranged to closely fit around the exterior of the center skeg. The support yoke is adapted to receive the center skeg of the boat. A pair of wheels is rotatably mounted on the support yoke to provide mobility to the dolly.

Preferably, the first and second elongate arms are of a size such as to form a tight fit of each arm between the skeg and its respective hull portion to prevent slippage of the boat on the dolly. In the preferred embodiment, the boat dolly includes a backplate affixed to a first end of each of the elongate arms and adapted to abut the transom of the boat when the dolly is in place to prevent fore/aft movement of the boat on the dolly. Also, in the preferred embodiment, at least one adjustable strap has its first end affixed to the backplate and has a hook attached to its second end. The hook engages the transom of the boat, such that the strap is held taut and securely holds the boat on the dolly. It is desirable to secure the bow of the boat to the dolly and for this purpose, the preferred embodiment of the dolly includes a Y-shaped harness having three straps meeting at a common point and providing three free ends for attachment to the dolly and the boat. Two of the free ends are affixed to the second ends of the first and second elongate arms. The third free end has a hook attached to it that is adapted to engage the bow of the boat when the boat is in place on the dolly. Preferably this three-point harness arrangement has a length adjustment means associated with it to enable the operator to tighten the harness to securely attach the boat to the dolly.

BRIEF DESCRIPTION OF THE DRAWINGS

The objects and advantages of the invention will be better understood by those of ordinary skill in the art and others upon reading the ensuing specification when taken in conjunction with the appended drawings wherein:

FIG. 1 is an isometric view of one embodiment of a boat dolly made in accordance with the principles of the present invention;

FIG. 2 is an isometric view from a different viewing angle of the boat dolly of FIG. 1;

FIG. 3 is a side elevational view in partial section of the boat dolly of FIG. 1 in position attached to a boat.

DETAILED DESCRIPTION OF THE PREFERRED EMBODIMENT

Figure 4:
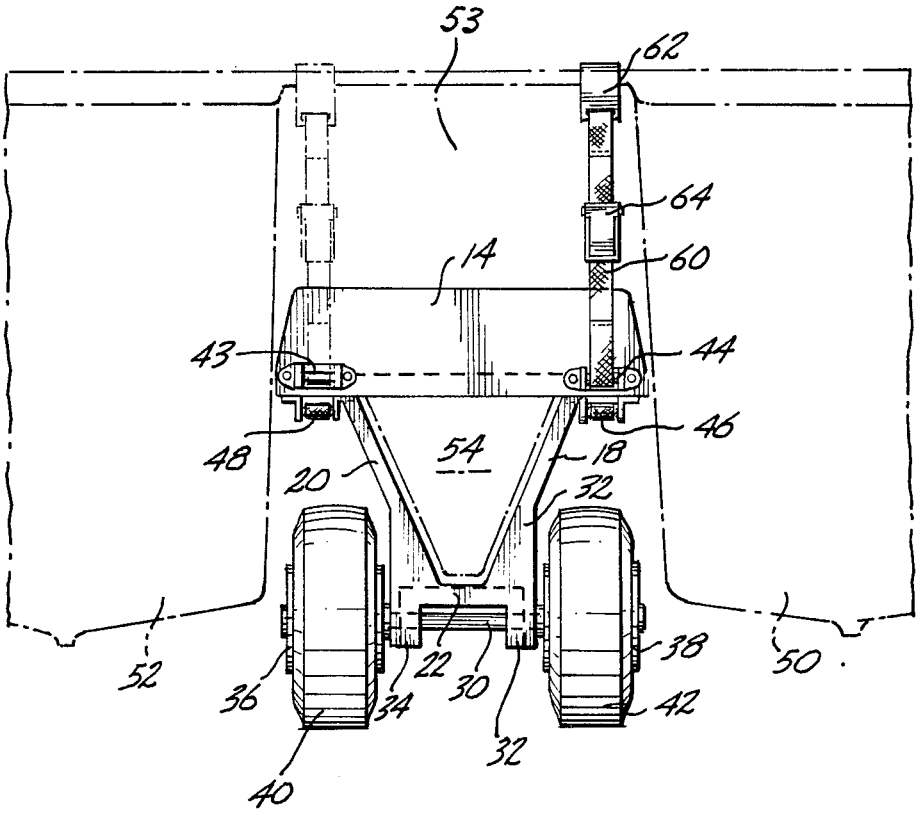
FIG. 4 is a rear elevational view of the boat dolly of FIG. 1 in position on a multihull boat.

One embodiment of a boat dolly made in accorance with the principles of the present invention is shown in FIG. 1 and includes a first elongate arm 10 and a second elongate arm 12, arranged in parallel to one another. A backplate 14 is affixed to a first end of each of the first and second elongate arms. The second ends of each of the elongate arms are preferably beveled as illustrated. A first support yoke assembly 16 includes first and second side yoke members 18 and 20, respectively, that have first ends affixed to and depending from the first and second elongate arms. The side yoke members converge toward one another and have their second ends affixed to a base member 22 so as to form substantially a truncated V pattern. A similar second support yoke assembly depends from said first and second elongate arms adjacent the second ends thereof and includes a second set of downwardly depending side yoke members 24 and 26 and a second base member 28. An axle 30 passes through axle support members 32 and 34, which are affixed to and depend downwardly from the first and second side members 18 and 20 of the first support yoke assembly 16. Wheels 36 and 38 are respectively rotatably mounted on the first and second ends of the axle 30 and preferably tires 40 and 42 are mounted on the wheels. As best seen in FIG. 2, a pair of identical strap fittings 43 and 44, respectively, are mounted on the backside of backplate 14 adjacent the side edges of the backplate. Also, strap fittings 46 and 48, respectively, are mounted on the underside of the second ends of each of the elongate arms 10 and 12.

Referring now to FIGS. 3 and 4, one embodiment of the boat dolly of the present invention is shown in position supporting a boat of multihull design. For purposes of the present description, a multihull boat design is defined as having right and left major boat hull portions 50 and 52 as shown in phantom line in FIG. 4. The hull portions 50 and 52 are separated by a center hull portion 53. As seen in FIG. 4, the center hull portion 53 cooperates with the right and left hull portions 50 and 52 to define an open-bottomed tunnel between the right and left hull portions. A longitudinal extending center skeg 54 depends downwardly from the center hull portion 53 and lies substantially within the tunnel formed by the right, left, and center hull portions. The skeg 54 is of substantially V-shaped cross section, truncated at the bottom, and is spaced from both the right and left hull portions. The skeg 54 and the hull portions 50, 52, and 53 cooperate to define right and left channels on either side of the skeg 54. The upper surfaces of the right and left channels are defined by the bottom surface of the center hull portion. Boats of this type are manufactured and sold by Livingston, Incorporated of Auburn, Washington; Sorenson Boats manufactured by Dick Clarke, Inc. of Federal Way, Washington; and boats sold under the trade name CALYPSO by L & M Manufacturing, Inc. of Anacortes, Washington.

The boat dolly is mounted on the boat by sliding the first and second elongate arms 10 and 12 into the space between the center skeg 54 and the right and left boat hull portions 50 and 52, respectively, so that the elongate arms hold the center skeg between them and prevent sideways motion of the boat on the dolly. The dolly is moved onto the boat until the backplate 14 abuts the transom or rear plate of the boat hull. Preferably, the arms 10 and 12 are of a size such that they form a tight interference fit to firmly position themselves between the hull portions and the center skeg. Also, the length of the arms 10 and 12 is determined by the length of the boat for which they are to be used and they are of a size long enough to provide some stability to the boat to prevent it from being front-heavy and tending to tip off of the dolly, but not yet so long as to unduly increase the weight of the dolly. The bevel on the second ends of the arms 10 and 12 is adapted to provide a close abutment of the ends of the arms to the underside of the hull. The first and second support yoke assemblies surround the skeg when the dolly is in position as can be seen in FIG. 4 and transfer the load of the boat from the arms to the wheels and tires. The tires 40 must be of a size small enough to fit within the space between the right and left hull portions and the support yoke assembly without rubbing, but yet should be large enough to facilitate easy mobility of the dolly, with the boat mounted thereon, on loose soils and sand typically found around bodies of water.

While the interference fit of the elongate arms between the skeg and hull portions of the boat, and the general sizing of the dolly with respect to the boat with which it is to be used, act to prevent undue motion of the boat with respect to the dolly and to keep the boat positioned on the dolly, it is nevertheless preferable to further secure the boat to the dolly by means of various straps connected to both the boat and the dolly. One such strap 60 is shown at the rear of the boat in FIG. 3. A first end of the strap is affixed to the strap holder 44 and the second end of the strap has a hook 62 attached thereto that hooks to the transom of the boat. Preferably, some means, such as buckle 64, is attached to the strap between the first and second ends thereof to provide a means of tensioning the strap to secure the boat to the dolly. While a single strap could be used at the rear of the boat, it is preferable to use two straps in order to provide even loading of the boat on the dolly and thereby decreasing the possibility of deformation of either the boat or the dolly caused by uneven tensioning of the straps. Also, a single strap would be best placed in the center of the backplate, and might interfere with an outboard motor mounted on the boat. The two-strap arrangement allows the center of the backplate to be open, thereby eliminating any possibility of interference with an outboard motor. A second strap is typically attached to strap holder 42 and hooked to the transom at the opposite side of the rear of the boat to provide equalization of force from side to side of the boat.

Since the elongate arms 10 and 12 are typically quite a bit shorter than the overall length of the boat that is to be transported on the dolly, the bow of the boat is attached to the dolly by means of a harness arrangement 66 that is attached to the bow of the boat and to the dolly. The harness 66 consists of two branches 67 that are attached respectively to the strap holders 46 and 48. The harness 66 has a third branch 68 that has a hook 70 attached to it, the hook 70 being adapted to engage the bow of the boat. Again, some sort of adjustable buckle arrangement 72 is mounted on the harness 66, preferably on the third branch 68 adjacent the hook 70 so that the buckle is easily reachable by a person within the boat to permit tensioning of the harness 66.

In its preferred embodiment, the dolly is to be constructed of material that enables it to float for ease of removal from the boat after the boat is in the water. In typical operation, the dolly would be attached to the boat while it was in transit on a car or truck to the body of water in which it would be used. The dolly would then be used to roll the boat from the car or truck to the launching area and the boat actually rolled into the water on the dolly. While the boat was floating in the water, the boater would be able to reach the tension adjustment buckles on the rear straps and on the harness 66 from within the boat to loosen the tension on those straps and permit the hooks to be removed from the transom and bow of the boat. The dolly could be floated out from under the boat and gathered up by the boater to be either left on the shore or placed within the boat while it was in use. The dolly could conceivably be left in position while the boat was in use if the boater was willing to put up with the additional drag that the dolly would have on the boat hull.

The critical features of the boat dolly of the present invention have been described above, however, there are other additional features of a preferred nature that must be taken into consideration in the construction of the dolly. The backplate 14 should not be too high so that it does not interfere with the mounting of an outboard motor to the transom of the boat. Alternatively, the backplate 14 could be as high as the transom of the boat but have a notch cut out in the center of it to accommodate the mounting of an outboard motor. The frame of the dolly is preferably of one-piece molded high-impact plastic and the elongate arms are preferably hollow to provide buoyancy so that the dolly can be floated out from under the boat as described above and also so that the dolly is easily maneuverable with or without the boat mounted thereon. The backplate 14 and the axle supports are preferably of a solid construction for the added strength that such solid construction provides. Rather than having adjustable buckle-tensioning means on the transom straps, it would also be possible to use a bungee or other elastic cord to provide tension without any buckle. The tires used on the dolly are preferably pneumatic tires sufficiently large to provide easy mobility on sand and loose soils normally found around bodies of water. As was described above, the tires must be of a size small enough so that they fit in the space between the support yoke and the sides of the hull portions without rubbing.

While the dolly must be adapted for use with a particular size hull of boat, the following are typical dimensions of a dolly that could be used with an eight- to nine-foot length multihull boat, as sold by Livingston, Incorporated of Auburn, Washington. Such a dolly would have arms that are about 20 inches long and the total outside width of the dolly would be about 13 inches. The arms themselves would be approximately $3\frac{1}{2}$ inches wide and $\frac{3}{4}$ inch to one inch thick. The backplate would be constructed of material of a thickness of 3/8 to $\frac{1}{2}$ inch. Since the dolly is intended to be immersed in water during its use, it is preferable to make it of a nonporous plastic material. The wheels 36 and 38 are preferably nylon wheels with plastic bearings inserted in the wheels to receive the ends of the axle 30. The axle itself is preferably of stainless steel to resist corrosion caused by the use in water. It is to be understood that all of the dimensions and materials listed herein are exemplary only and they are not meant to limit the scope of the invention.

While a preferred embodiment of a lightweight, easily mountable and demountable boat dolly for use with a multihull small boat has been illustrated and described herein, it should be apparent to those of ordinary skill in the art and others that several changes can be made to the illustrated and described embodiment of the invention while remaining within the scope of the invention. Therefore, the invention should be defined solely by reference to the claims that follow.

The embodiments of the invention in which an exclusive property or privilege is claimed are defined as follows

1. A boat dolly for use in conjunction with a boat of multihull construction, said boat including a right hull portion, a left hull portion, and a center hull portion joining said right and left hull portions, to define a tunnel between said right and left hull portions, a transom at the rear of said hull portions of said boat, and said boat further including a longitudinally extending center skeg, depending downwardly from said center hull portion within said tunnel, said right, left, and center hull portions and said skeg cooperating to define right and left channels on either side of said skeg, each channel having an upper surface defined by a bottom surface of said center hull portion, said dolly comprising:

elongate first and second arms substantially parallel to one another and constructed and arranged such that each arm is of a size to form an interference fit within an associated one of said right and left channels, each of said first and second arms including an upper surface shaped to conform to the upper surface of its associated channel such that the boat is firmly but releasably held on said dolly by the interference fit beteen said arms and said channels;

a backplate affixed to a first end of each of said first and second arms in orthogonal relation to said arms, said backplate constructed and arranged to abut the transom of said boat when said boat is on said dolly;

a first support yoke depending from said first and second arms, said first support yoke being shaped correspondingly to the shape of said skeg and adapted to closely receive said skeg; and a pair of wheels rotatably mounted on said support yoke.

2. The boat dolly of claim 1, further including at least one transom strap attached at a first end thereof to said backplate and having a first hook means attached to a second end thereof, said hook means adapted for being removably attached to the hull of said boat when said boat is mounted on said dolly.

3. The boat dolly of claim 2, further including a forward harness assembly including a first elongate bow strap having attached at a first end thereof the first ends of first and second elongate branch straps such that said bow strap and said branch straps are configured in a Y configuration, a second end of each of said branch straps being attached to a second end of each of the elongate arms, a second end of said bow strap having a second hook means attached thereto, said second hook means being adapted for removable attachment to the bow of said boat when said boat is mounted on said dolly.

4. The boat dolly of claim 3, further including first adjustable buckle means mounted on said transom strap and second adjustable buckle means mounted on said bow strap for adjusting the length of said transom strap and said bow strap.

5. The boat dolly of claim 4, further including a second transom strap affixed at a first end thereof to said backplate and having a third hook means attached to a second end of said second transom strap.

6. The boat dolly of claim 5, further including third adjustable buckle means mounted on said second transom strap for adjusting the length of said second transom strap.

7. The boat dolly of claim 2, wherein said first transom strap is an elastomeric member.

8. The boat dolly of claim 3, wherein said bow strap is an elastomeric member.

9. The boat dolly of claim 1, further including first and second axle support members depending from said first support yoke; and an axle rotatably mounted within said axle support members, said wheels being rotatably attached to respective first and second ends of said axle.

10. The boat dolly of claim 9, wherein said wheels have pneumatic tires mounted thereon.

11. The boat dolly of claim 1, further including a second support yoke depending from said first and second elongate arms, said second support yoke being positioned such that when the boat is mounted on said dolly said second support yoke is intermediate of the bow of said boat and said first support yoke.

12. The boat dolly of claim 11, wherein said first and second support yokes are of a size such that they are adapted to closely fit the exterior of said center skeg.

13. The boat dolly of claim 1, wherein said backplate is of a height shorter than the transom of said boat.

14. The boat dolly of claim 11, wherein said first and second elongate arms, backplate, first and second support yokes, and said first and second axle supports are integrally formed of a nonporous nonmetallic material and wherein further said first and second elongate arms are closed hollow members, said dolly being buoyant.

* * * * *